US011309661B2

(12) United States Patent
Obata

(10) Patent No.: US 11,309,661 B2
(45) Date of Patent: Apr. 19, 2022

(54) CONNECTOR ASSEMBLY

(71) Applicant: JAPAN AVIATION ELECTRONICS INDUSTRY, LIMITED, Tokyo (JP)

(72) Inventor: Yusuke Obata, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/089,868

(22) Filed: Nov. 5, 2020

(65) Prior Publication Data

US 2021/0234305 A1 Jul. 29, 2021

(30) Foreign Application Priority Data

Jan. 24, 2020 (JP) ..... JP2020-009806

(51) Int. Cl.
*H01R 13/627* (2006.01)
*H01R 13/631* (2006.01)

(52) U.S. Cl.
CPC ..... *H01R 13/6272* (2013.01); *H01R 13/631* (2013.01)

(58) Field of Classification Search
CPC ..... H01R 13/6271–6273; H01R 13/631
USPC ..... 439/357, 358
See application file for complete search history.

(56) References Cited

U.S. PATENT DOCUMENTS 6,419,515 B1 * 7/2002 Okayasu ..... H01R 13/627 439/352
7,604,496 B2 * 10/2009 Takeuchi ..... H01R 13/6275 439/358
7,666,023 B2 * 2/2010 Wu ..... H01R 13/6275 439/352
9,680,254 B1 6/2017 Nishikata et al.
9,905,965 B2 2/2018 Tanaka et al.
10,141,687 B2 11/2018 Hashiguchi
(Continued)

FOREIGN PATENT DOCUMENTS

CN 207542475 U 6/2018
CN 208045870 U 11/2018
(Continued)

OTHER PUBLICATIONS

Extended European Search Report (EESR) dated Apr. 23, 2021 issued in counterpart European Application No. 20209081.7.

*Primary Examiner* — Gary F Paumen
(74) *Attorney, Agent, or Firm* — Holtz, Holtz & Volek PC

(57) ABSTRACT

A connector assembly comprises a first connector and a second connector mateable with each other along a front-rear direction (X-direction). The first connector comprises a first inner structure and a first outer member having a first lock surface, a first regulation portion and a first abutment portion. The second connector comprises a second inner structure having a second abutment portion, and a second outer member having a second lock surface and a second regulation portion. The second abutment portion is brought into abutment with the first abutment portion when the second connector is mated with the first connector. Under a mated state where the first connector and the second connector are mated with each other, the second lock surface regulates a rearward movement of the second connector relative to the first connector, and the second regulation portion regulates a forward movement of the second connector relative to the first connector.

8 Claims, 9 Drawing Sheets

(56) References Cited

U.S. PATENT DOCUMENTS

| | | | | |
|---|---|---|---|---|
| 10,276,973 | B2 | 4/2019 | Hashiguchi | |
| 2003/0211785 | A1 | 11/2003 | Fujita et al. | |
| 2014/0273596 | A1* | 9/2014 | Li | H01R 9/16 439/357 |
| 2015/0147901 | A1* | 5/2015 | Wu | H01R 13/639 439/357 |
| 2015/0295361 | A1 | 10/2015 | Miyoshi | |
| 2016/0164224 | A1* | 6/2016 | Sekino | H01R 13/6272 439/352 |

FOREIGN PATENT DOCUMENTS

| | | | |
|---|---|---|---|
| EP | 3467958 | A1 | 4/2019 |
| JP | 2017068947 | A | 4/2017 |
| JP | 2017098052 | A | 6/2017 |

* cited by examiner front-rear direction

CONNECTOR ASSEMBLY

CROSS REFERENCE TO RELATED APPLICATIONS

This application is based on and claims priority under 35 U.S.C. § 119 to Japanese Patent Application No. JP 2020-009806 filed Jan. 24, 2020, the content of which is incorporated herein in its entirety by reference.

BACKGROUND OF THE INVENTION

This invention relates to a connector assembly comprising a first connector and a second connector mateable with each other.

For example, this type of connector assembly is disclosed in CN207542475U (Patent Document 1), the content of which is incorporated herein by reference.

Referring to FIGS. 17 and 18, Patent Document 1 discloses a connector assembly 90 comprising a first connector 92 and a second connector 95 which are mateable with each other along a front-rear direction. The first connector 92 comprises an inner structure 93 and an outer member 94, the inner structure 93 including a first connector body 932, the outer member 94 being attached to the inner structure 93. The second connector 95 comprises an inner structure 96 and an outer member 97, the inner structure 96 including a second connector body 962, the outer member 97 being attached to the inner structure 96. The outer member 94 of the first connector 92 is formed with a lock projection 942. The outer member 97 of the second connector 95 is formed with a lock groove 972.

Referring to FIG. 18, when the first connector 92 and the second connector 95 are under a mated state where they are mated with each other, the second connector 95 is partially inserted into the first connector 92 so that the first connector 92 and the second connector 95 are electrically connected with each other. Under the mated state, the lock projection 942 is received in the lock groove 972 so that the mated state is locked.

For a connector assembly as in Patent Document 1, the second connector needs to be inserted into the first connector along a mating direction (front-rear direction) until the mated state is locked. During this insertion, the end of the second connector body might be occasionally brought into abutment with an innermost portion of the first connector body before the mated state is locked. In such a case, when the mated state is locked, the end of the second connector body might be pressed against the innermost portion of the first connector body to be damaged. Thus, the existing technique has a drawback which might cause damage to the connector body, which is at least one of the first connector body and the second connector body, during a mating operation in which the first connector is mated with the second connector.

SUMMARY OF THE INVENTION

It is therefore an object of the present invention to provide a connector assembly having a mechanism for preventing damage to a connector body thereof during a mating operation in which a first connector and a second connector thereof are mated with each other.

Upon a mating operation of a second connector with a first connector in an existing connector assembly, the second connector is allowed to be moved along a front-rear direction either until an outer member of the first connector is brought into abutment with an outer member of the second connector or until an inner structure of the first connector is brought into abutment with an inner structure of the second connector, so that the mated state can be locked. In this connector assembly, a connector body of the first connector might be pressed against a connector body of the second connector because of manufacturing or assembling tolerances of various members of the first connector and the second connector. Theoretically, this problem can be solved by substantially eliminating the tolerances. However, considering manufacturing cost, such a solution is not practical.

The inventor of the present invention has invented a new mechanism based on the consideration described above. In this new mechanism, the second connector is allowed to be moved along the front-rear direction until the inner structure of the second connector is brought into abutment with the outer member of the first connector while the mated state is locked by the outer member of the first connector and the outer member of the second connector. With the connector assembly of the present invention which has this mechanism, damage to the connector body thereof can be prevented while tolerances thereof are allowed. Specifically, the present invention provides the connector assembly described below.

An aspect of the present invention provides a connector assembly comprising a first connector and a second connector. The second connector is mateable with the first connector along a front-rear direction under a state where the first connector is located forward of the second connector in the front-rear direction. The first connector comprises a first inner structure and a first outer member. The first inner structure comprises a first connector body. The first outer member is attached to the first inner structure. The first outer member has a first lock surface, a first regulation portion and a first abutment portion. The first lock surface faces forward. The first regulation portion faces rearward. The first abutment portion faces rearward. The second connector comprises a second inner structure and a second outer member. The second inner structure comprises a second connector body and a second abutment portion. The second connector body is connected to the first connector body under a mated state where the first connector and the second connector are mated with each other. The second abutment portion faces forward. The second abutment portion is brought into abutment with the first abutment portion when the second connector is mated with the first connector. The second outer member is attached to the second inner structure. The second outer member has a second lock surface and a second regulation portion. The second lock surface faces rearward. Under the mated state, the second lock surface faces the first lock surface in the front-rear direction and regulates a rearward movement of the second connector relative to the first connector. The second regulation portion faces forward. Under the mated state, the second regulation portion faces the first regulation portion in the front-rear direction and regulates a forward movement of the second connector relative to the first connector. The first regulation portion and the first lock surface are apart from each other by a first distance in the front-rear direction. The second regulation portion and the second lock surface are apart from each other by a second distance in the front-rear direction. In a structure in which the first regulation portion is located forward of the first lock surface, the first distance is longer than the second distance. In another structure in which the first regulation portion is located rearward of the first lock surface, the first distance is shorter than the second distance. Under the mated state, the second outer member is movable relative to the first outer member along the front-rear direction.

According to an aspect of the present invention, the second connector is moved forward along the front-rear direction to be mated with the first connector. When the second connector is mated with the first connector, the second abutment portion of the second inner structure is brought into abutment with the first abutment portion of the first outer member so that a further forward movement of the second connector is prevented. This mechanism prevents a movement of the second connector body of the second connector to a position at which the second connector body is brought into abutment with the first connector body of the first connector.

Under the mated state according to an aspect of the present invention, a rearward movement of the second connector relative to the first connector is regulated by the second lock surface of the second outer member and the first lock surface of the first outer member which face each other in the front-rear direction. In addition, a forward movement of the second connector relative to the first connector is regulated by the second regulation portion of the second outer member and the first regulation portion of the first outer member which face each other in the front-rear direction. Thus, the mated state is locked by the first outer member of the first connector and the second outer member of the second connector.

According to an aspect of the present invention, the position of the second lock surface of the second outer member in the front-rear direction is designed in consideration of tolerances so that the second lock surface can be located apart from the first lock surface of the first outer member under the mated state. In addition, the position of the second regulation portion of the second outer member in the front-rear direction is designed in consideration of tolerances so that the second regulation portion can be located apart from the first regulation portion of the first outer member under the mated state. As a result, under the mated state, the second outer member is movable relative to the first outer member along the front-rear direction by a predetermined distance. Thus, an aspect of the present invention provides the connector assembly having the mechanism which allows tolerances and prevents damage to the connector body during the mating operation of the first connector with the second connector.

An appreciation of the objectives of the present invention and a more complete understanding of its structure may be had by studying the following description of the preferred embodiment and by referring to the accompanying drawings.

Figure 1:
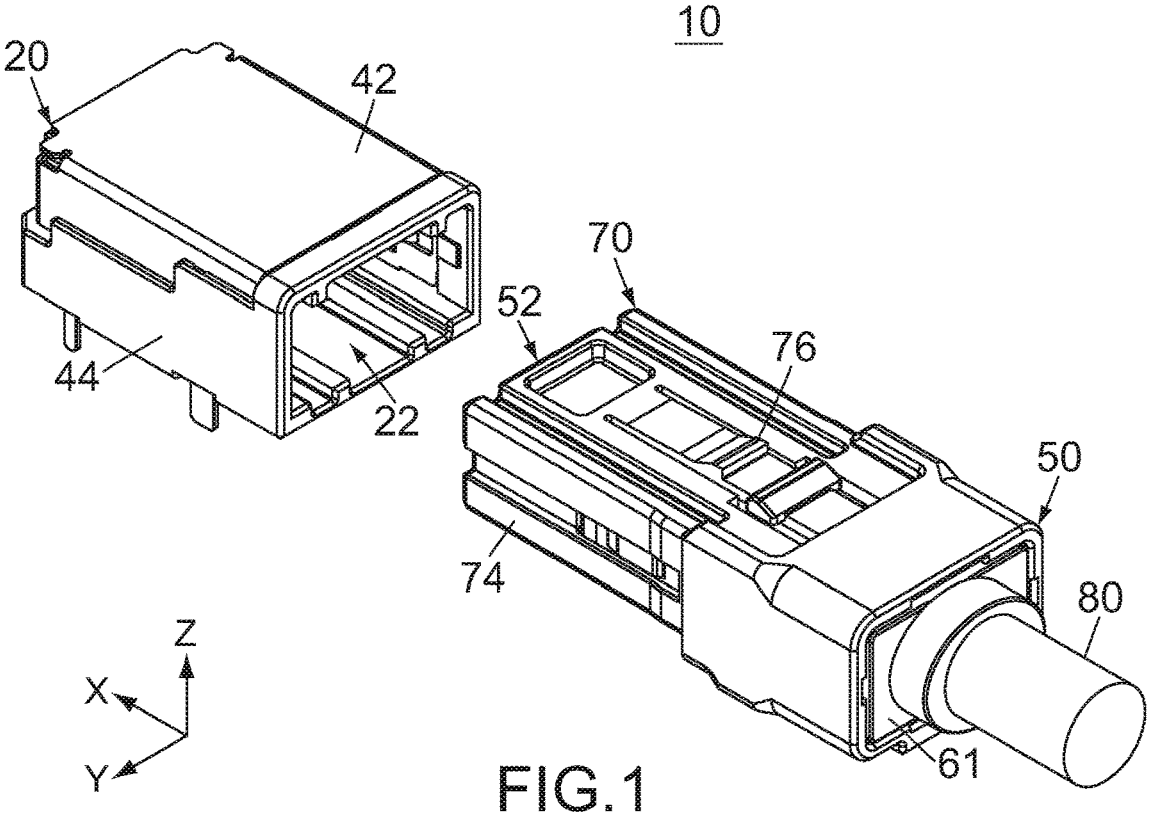
FIG. 1 is a perspective view showing a connector assembly according to an embodiment of the present invention, wherein a first connector and a second connector of the connector assembly are separated from each other, and the second connector is connected to a cable.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
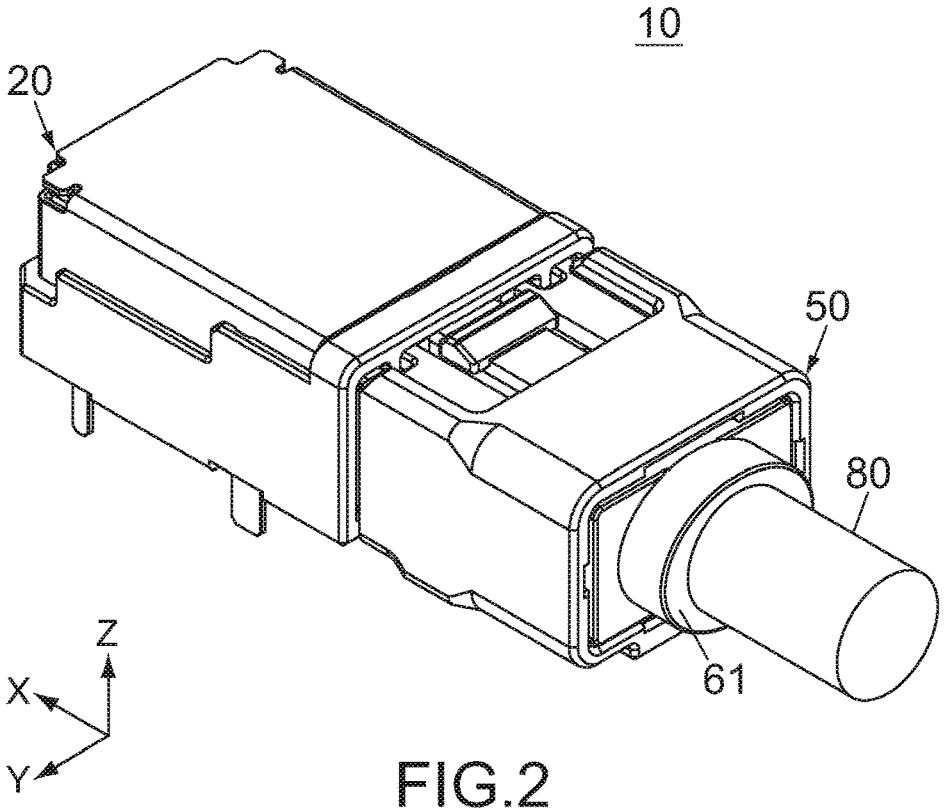
FIG. 2 is a perspective view showing the connector assembly of FIG. 1, wherein the first connector and the second connector are mated with each other.
Figure 3:
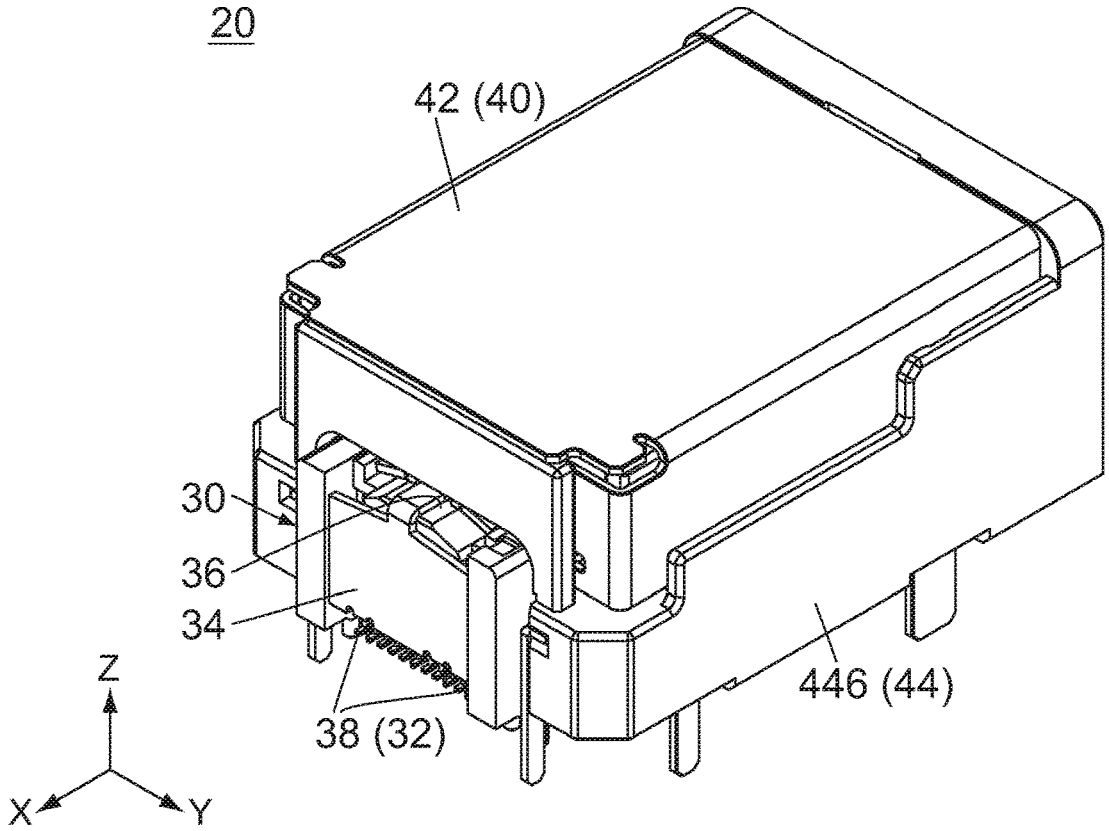
FIG. 3 is a perspective view showing the first connector of the connector assembly of FIG. 1.

As shown in FIGS. 1 and 2, a connector assembly 10 according to an embodiment of the present invention comprises a first connector 20 and a second connector 50. The first connector 20 is a receptacle. The first connector 20 is mounted on a circuit board (not shown) when used. The second connector 50 is a plug. The second connector 50 is connected to a cable 80 when used. In other words, the first connector 20 of the present embodiment is an on-board receptacle connector, and the second connector 50 of the present embodiment is a cable plug connector. More specifically, the first connector 20 is a so-called angle type receptacle. However, the present invention is not limited thereto but is applicable to various connector assemblies. For example, the first connector 20 may be a plug, and the second connector 50 may be a receptacle. Moreover, the first connector 20 may be a cable connector similar to the second connector 50 and may be connected to a cable when used.

Referring to FIGS. 1 and 2, the first connector 20 and the second connector 50 are mateable with each other along a front-rear direction (X-direction). The first connector 20 and the second connector 50 illustrated in FIG. 1 are under a separated state where they are separated from each other. The first connector 20 illustrated in FIG. 1 is located forward of the second connector 50. When the second connector 50 under the separated state is moved forward, or moved along the positive X-direction, and toward the first connector 20, the first connector 20 and the second connector 50 change their state into a mated state, or a state shown in FIG. 2, where they are mated with each other. As described above, the second connector 50 is mateable with the first connector 20 along the X-direction under the separated state where the first connector 20 is located forward of the second connector 50 in the X-direction. Under the mated state, the first connector 20 and the second connector 50 are electrically connected with each other, so that an electronic device (not shown) in which the circuit board (not shown) of the first connector 20 is installed is electrically connected with another electronic device (not shown) connected to the cable 80.

Hereafter, explanation will be made about a basic structure of the first connector 20.

Figure 16:
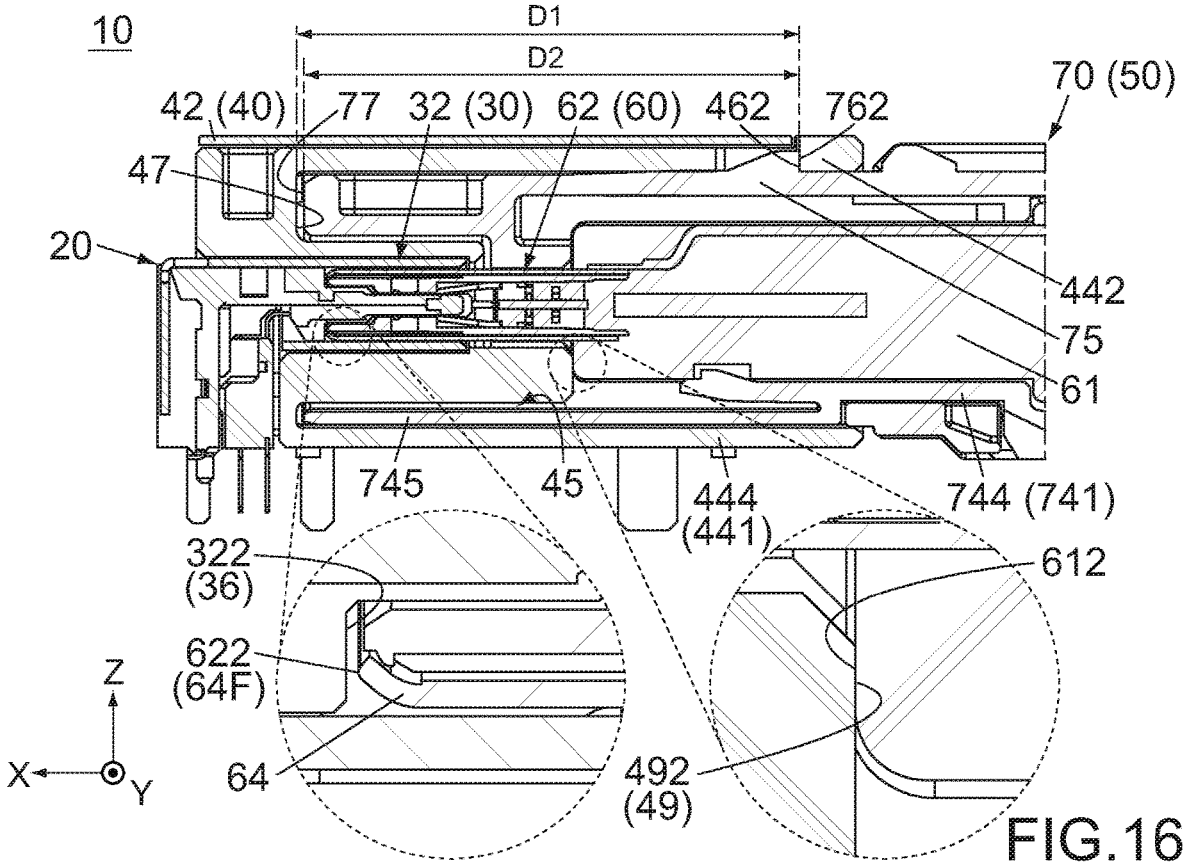
FIG. 16 is a cross-sectional view showing the first connector and the second connector of FIG. 15, wherein the second connector is completely mated with the first connector, and two parts of the connector assembly each enclosed by dashed line are enlarged and illustrated.
Figure 17:
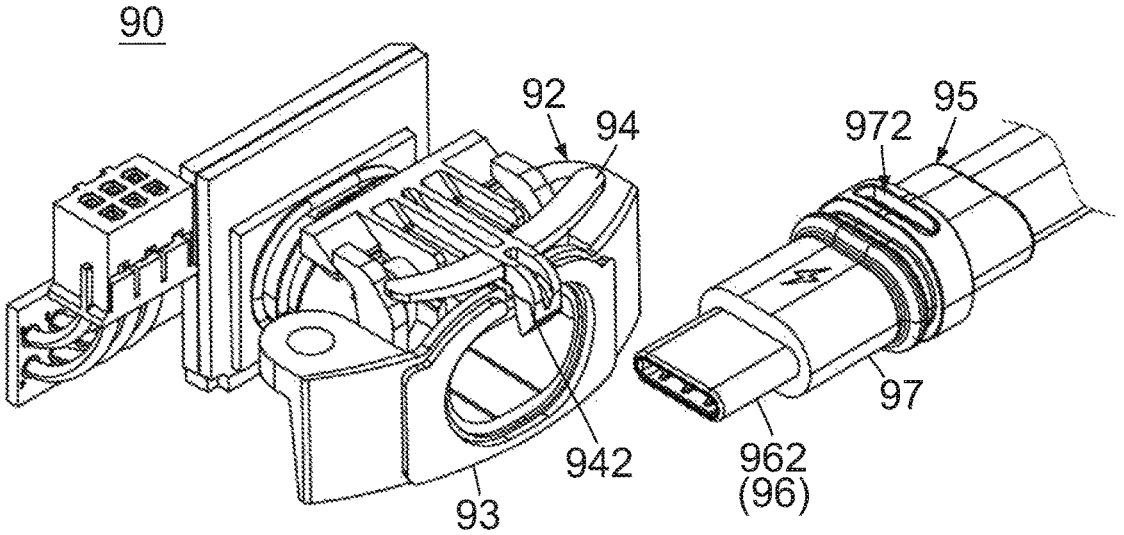
FIG.17 PRIOR ART
FIG. 17 is a perspective view showing a connector assembly of Patent Document 1, wherein a first connector and a second connector of the connector assembly are separated from each other.
Figure 18:
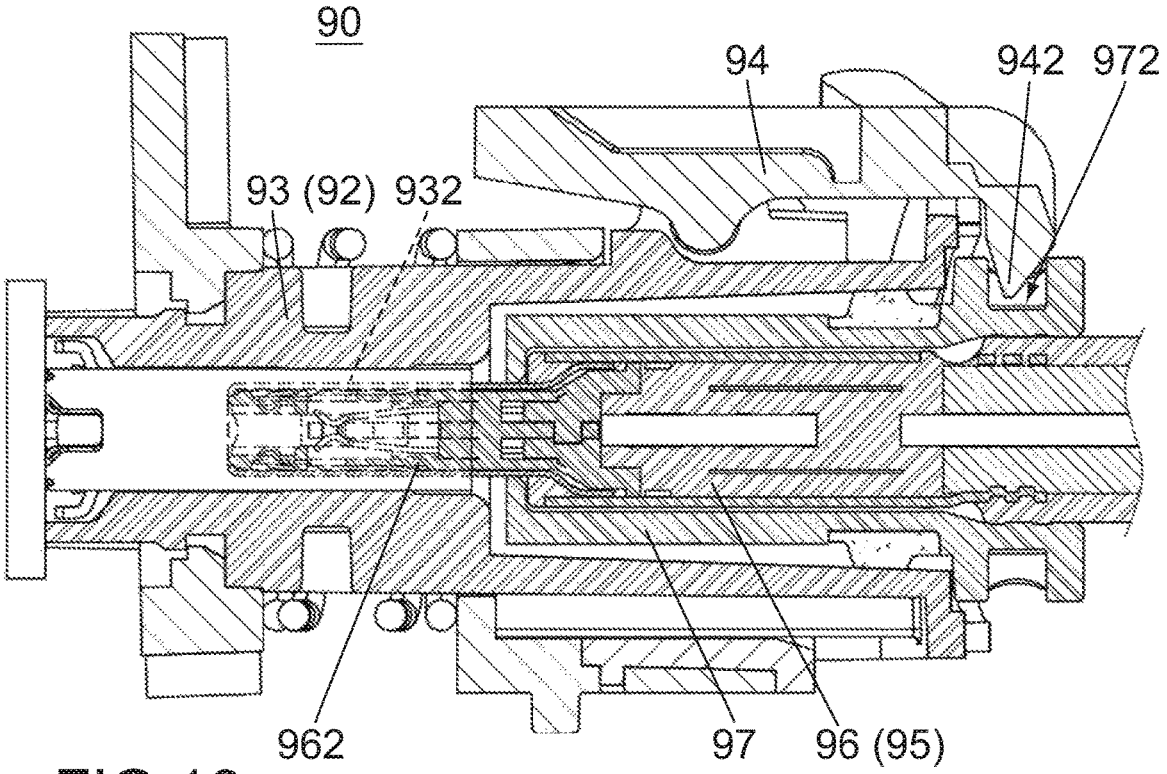
FIG.18 PRIOR ART
FIG. 18 is a cross-sectional view showing the connector assembly of FIG. 17, wherein the first connector and the second connector are mated with each other.

As shown in FIGS. 3 to 6, the first connector 20 of the present embodiment comprises a first inner structure 30 and a first outer member 40. Referring to FIG. 16, the first inner structure 30 is a member which works to electrically connect the first connector 20 and the second connector 50 under the mated state with each other. The first outer member 40 is a member which works to lock the mated state. Referring to FIGS. 3 to 6, the first outer member 40 is attached to the first inner structure 30. More specifically, the first inner structure 30 is inserted into the first outer member 40 from the front, so that the first connector 20 is fabricated.

The first connector 20 of the present embodiment comprises only the first inner structure 30 and the first outer member 40. However, the present invention is not limited thereto. For example, the first connector 20 may further comprise another member in addition to the first inner structure 30 and the first outer member 40.

Figure 5:
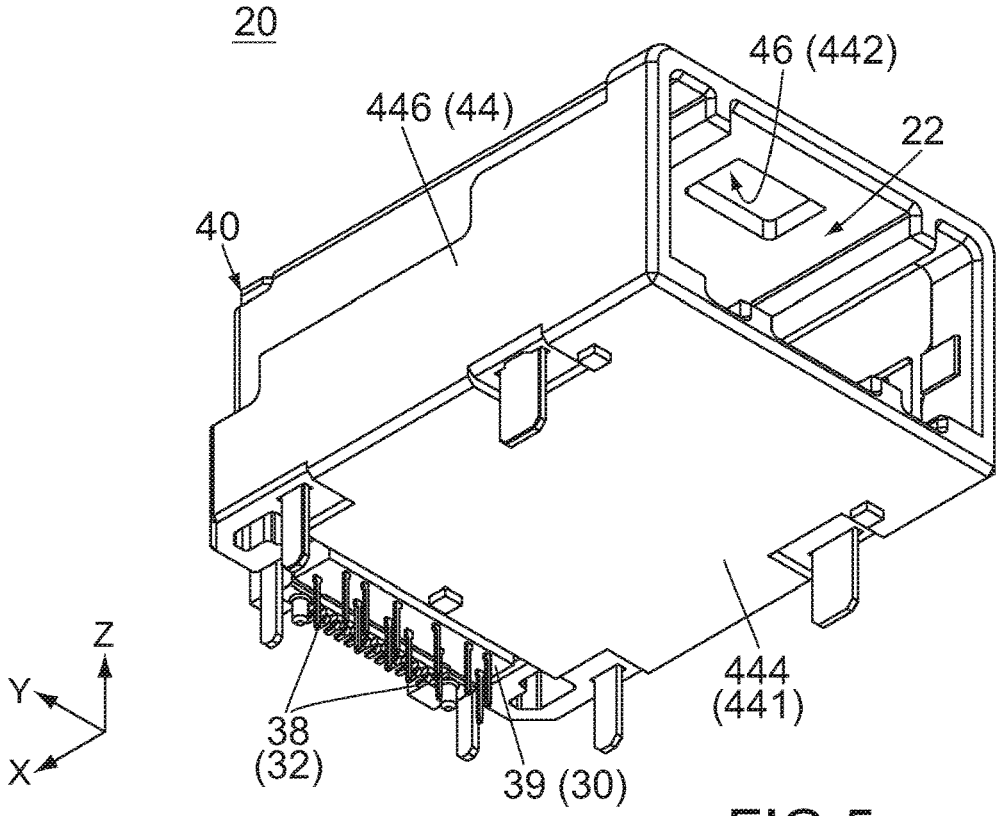
FIG. 5 is still another perspective view showing the first connector of FIG. 3.
Figure 6:
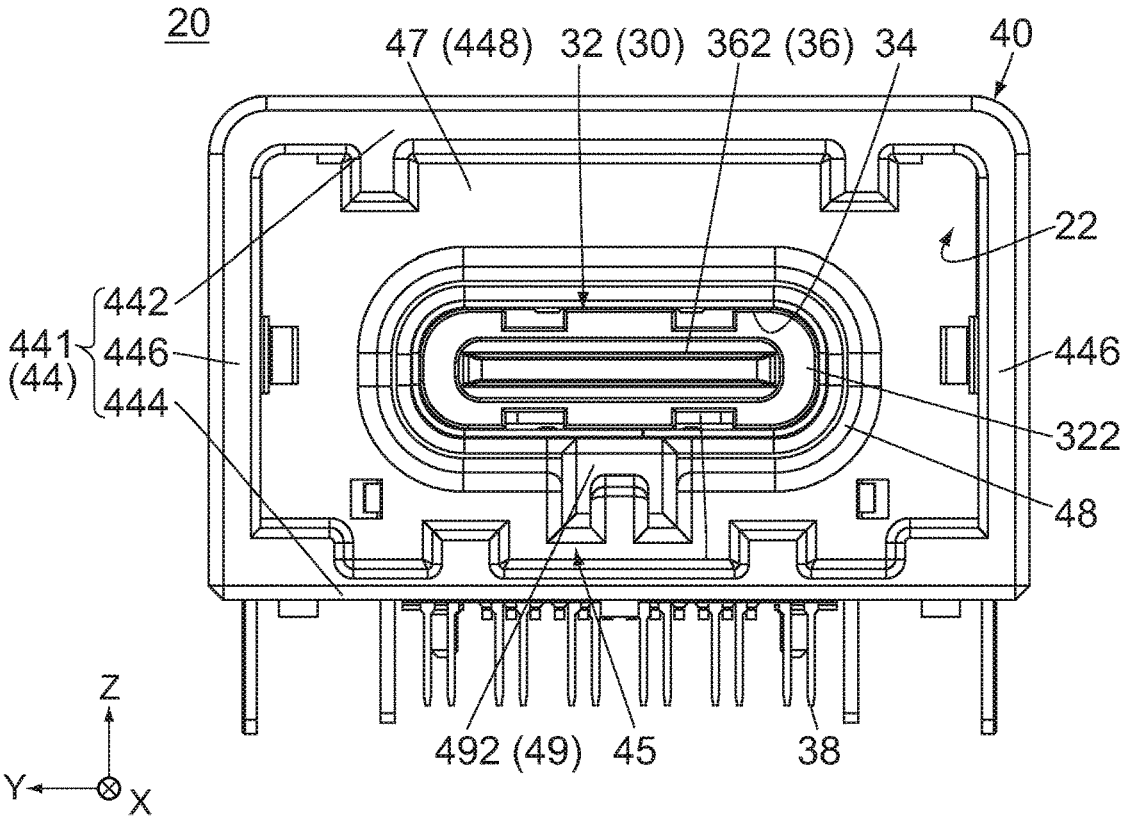
FIG. 6 is a front view showing the first connector of FIG. 3.
Figure 7:
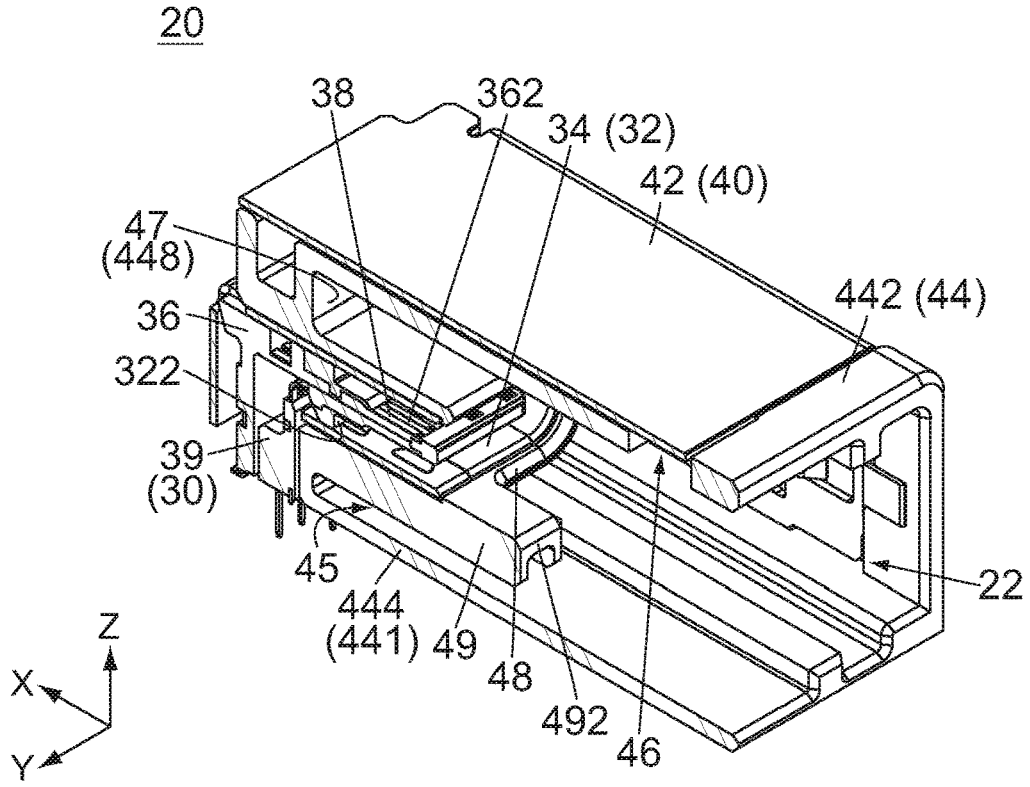
FIG. 7 is a partially cut-away, perspective view showing the first connector of FIG. 3.
Figure 8:
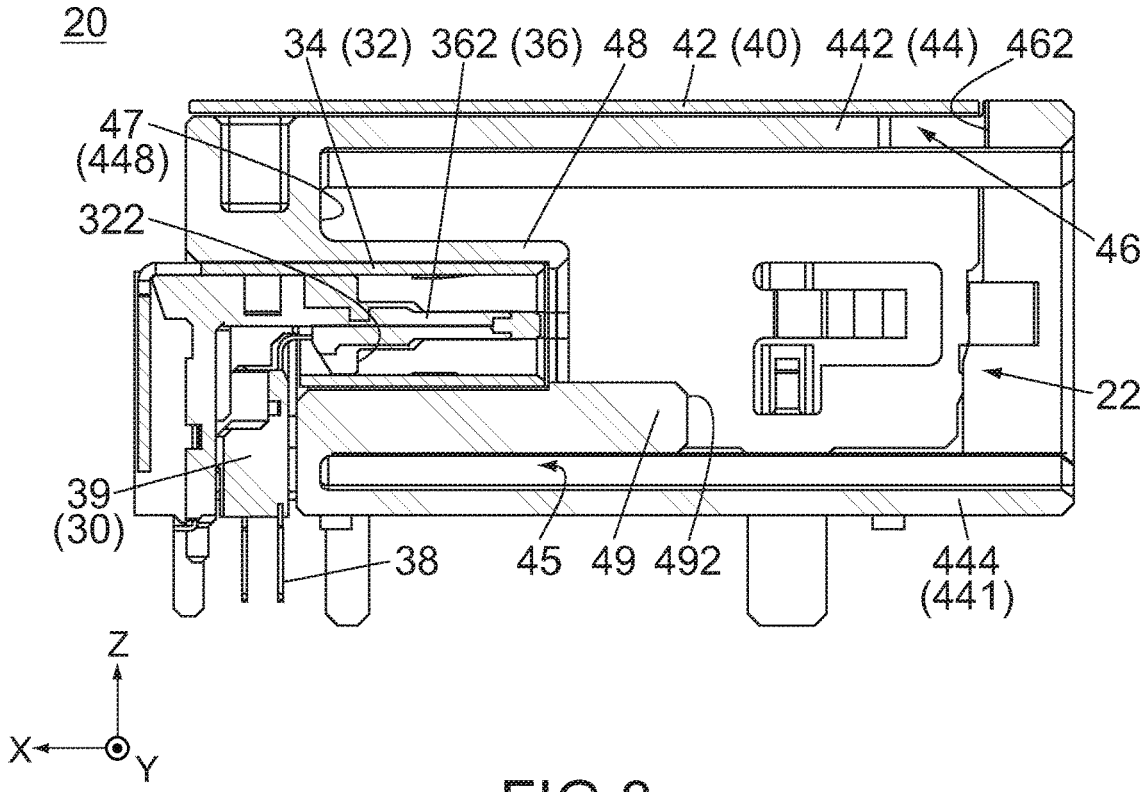
FIG. 8 is a cross-sectional view showing the first connector of FIG. 7.

As shown in FIGS. 3 to 8, the first inner structure 30 comprises a first connector body 32. Referring to FIGS. 7 and 8, the first connector body 32 of the present embodiment comprises a first inner shell 34 made of conductor, a first holding member 36 made of insulator, a plurality of first terminals 38 each made of conductor and an alignment member 39 made of insulator.

The first holding member 36 is formed of a plurality of members which are combined to each other. The first holding member 36 has a flat-plate portion 362. The flat-plate portion 362 is a rear part (negative X-side part) of the first holding member 36 and extends along a horizontal plane (XY-plane). The first terminals 38 are held by the first holding member 36. Each of the first terminals 38 has one end which is fixed on and connected to the circuit board (not shown) via soldering, etc. when the first connector 20 is used. Each of the first terminals 38 has the other end which is exposed from the flat-plate portion 362 and is electrically connected with the second connector 50 (see FIG. 1) under the mated state. The first inner shell 34 encloses the flat-plate portion 362 in a perpendicular plane (YZ-plane) perpendicular to the X-direction and defines an outer periphery of a rear part of the first connector body 32 in the YZ-plane. The alignment member 39 arranges some of the first terminals 38 in the horizontal plane.

The first inner structure 30 of the present embodiment comprises only the first connector body 32 which has the aforementioned structure. However, the present invention is not limited thereto, but the structure of the first inner structure 30 can be variously modified as necessary. For example, the first inner structure 30 may further comprise a member other than the first connector body 32. Moreover, the first connector body 32 may comprise another member in addition to the aforementioned members.

Referring to FIGS. 3, 4, 7 and 8, the first outer member 40 of the present embodiment comprises a first outer shell 42 made of conductor and a first outer housing 44 made of insulator.

Figure 4:
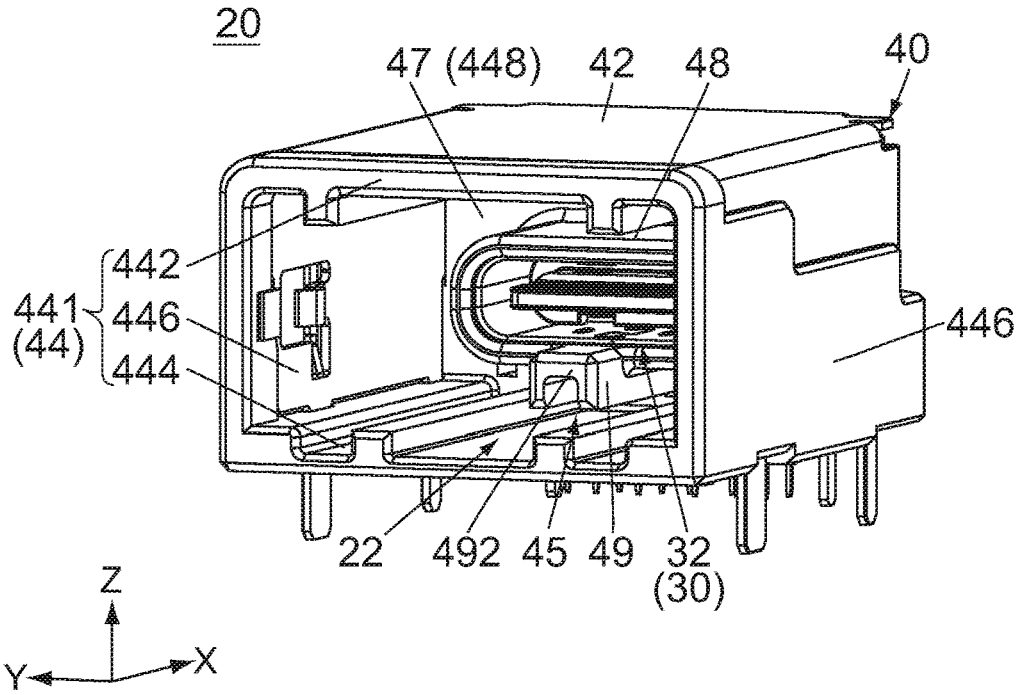
FIG. 4 is another perspective view showing the first connector of FIG. 3.

Referring to FIGS. 4 and 6, the first outer housing 44 of the present embodiment has an upper plate 442, a bottom plate 444, two side plates 446 and a back plate 448. The upper plate 442 is located on an upper side (positive Z-side) of the first outer housing 44 in an upper-lower direction (Z-direction) perpendicular to the X-direction and extends along the XY-plane. The bottom plate 444 is located on a lower side (negative Z-side) of the first outer housing 44 and extends along the XY-plane. The side plates 446 are located on opposite sides of the first outer housing 44, respectively, in a lateral direction (Y-direction) perpendicular to both the X-direction and the Z-direction and extend in parallel to each other along a predetermined plane (XZ-plane). The back plate 448 is located at a front end (positive X-side end) of the first outer housing 44 and extends along the YZ-plane.

The upper plate 442, the bottom plate 444 and the two side plates 446 of the first outer housing 44 form a first outer-peripheral portion 441. Thus, the first outer member 40 of the present embodiment has the first outer-peripheral portion 441. The first connector 20 is formed with a first receiving portion 22 which is defined by the first outer-peripheral portion 441 and the back plate 448. The first receiving portion 22 is a space enclosed by the first outer-peripheral portion 441 in the YZ-plane and opens rearward along the negative X-direction. The back plate 448 is located at a front end of the first receiving portion 22.

Referring to FIGS. 4, 6, 7 and 8, the first outer housing 44 of the present embodiment has a holding wall 48 and a projecting portion 49 in addition to the aforementioned portions. The holding wall 48 and the projecting portion 49 are located within the first receiving portion 22. The holding wall 48 is a cylindrical portion which opens forward and rearward. The holding wall 48 is provided on the middle of the back plate 448 in the YZ-plane and projects rearward from the back plate 448. The projecting portion 49 is provided on the middle of the holding wall 48 in the Y-direction. The projecting portion 49 protrudes downward along the negative Z-direction from a lower surface (negative Z-side surface) of the holding wall 48, and projects rearward from the back plate 448 beyond a rear end (negative X-side end) of the holding wall 48. The projecting portion 49 of the present embodiment is apart from the bottom plate 444 in the Z-direction, and a gap 45 is formed between the projecting portion 49 and the bottom plate 444.

Referring to FIGS. 6 to 8, the first inner shell 34 of the first connector body 32 has a shape corresponding to the inner space of the holding wall 48 in the YZ-plane. The first connector body 32 is inserted into the first outer member 40 from the front so that the first inner shell 34 is fit into the holding wall 48. The thus-inserted first connector body 32 is held by the first outer member 40. The holding wall 48 sandwiches and presses the first inner shell 34 so that the first inner shell 34 cannot be moved. Thus, the first inner structure 30 of the present embodiment is held so as to be unmovable relative to the first outer member 40.

Referring to FIGS. 5 and 8, the first outer housing 44 of the present embodiment has a lock hole 46. The lock hole 46 of the present embodiment is a hole formed in the upper plate 442. The lock hole 46 has a rectangular shape in the XY-plane. The lock hole 46 is located at the middle of the upper plate 442 in the Y-direction and passes through the upper plate 442 in the Z-direction.

Referring to FIG. 4, the first outer shell 42 of the present embodiment is a single metal plate with bends. The first outer shell 42 is attached to an outer periphery of the first outer housing 44 in the YZ-plane and mainly covers the upper plate 442 and the side plates 446.

The first outer member 40 of the present embodiment comprises the first outer shell 42 and the first outer housing 44 each of which has the structure as described above. However, the present invention is not limited thereto, but the structure of the first outer member 40 can be variously modified. For example, the first outer shell 42 may be provided as necessary.

Hereafter, explanation will be made about a basic structure of the second connector 50.

As shown in FIGS. 9 to 12, the second connector 50 of the present embodiment comprises a second inner structure 60 and a second outer member 70. Referring to FIG. 16, the second inner structure 60 is a member which works together with the first inner structure 30 of the first connector 20 to electrically connect the first connector 20 and the second connector 50 under the mated state with each other. The second outer member 70 is a member which works together with the first outer member 40 of the first connector 20 to lock the mated state. Referring to FIGS. 9 to 12, the second outer member 70 is attached to the second inner structure 60. More specifically, the second inner structure 60 is inserted into the second outer member 70 from behind, so that the second connector 50 is fabricated.

The second connector 50 of the present embodiment comprises only the second inner structure 60 and the second outer member 70. However, the present invention is not limited thereto. For example, the second connector 50 may further comprise another member in addition to the second inner structure 60 and the second outer member 70.

Figure 9:
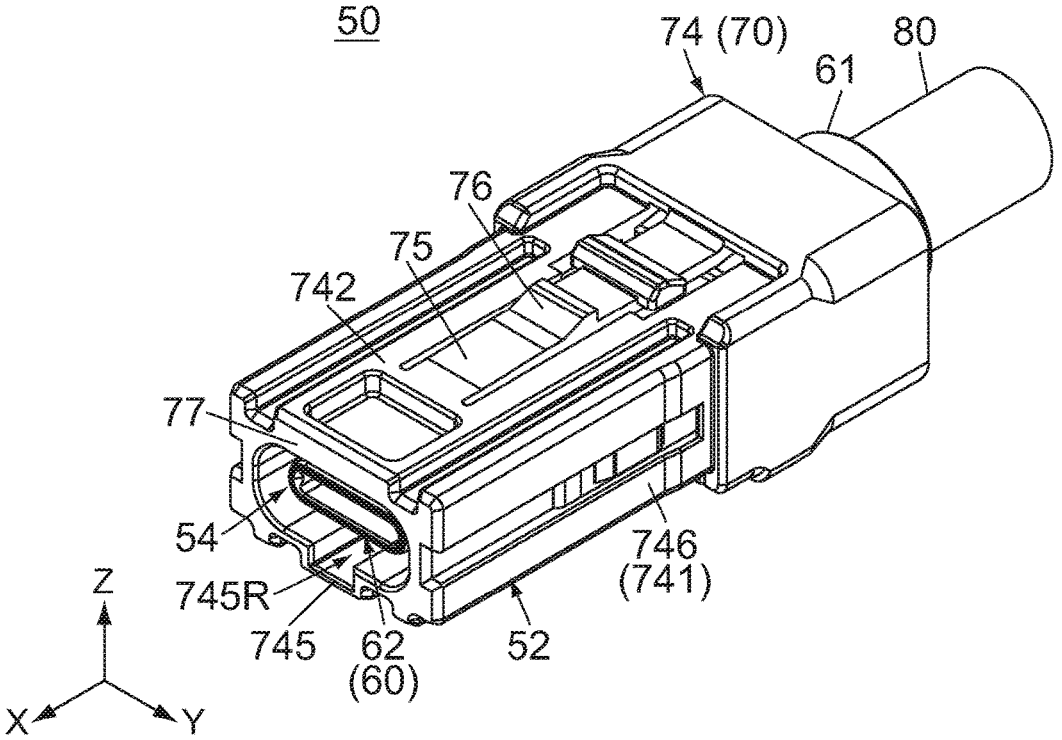
FIG. 9 is a perspective view showing the second connector of the connector assembly of FIG. 1.
Figure 13:
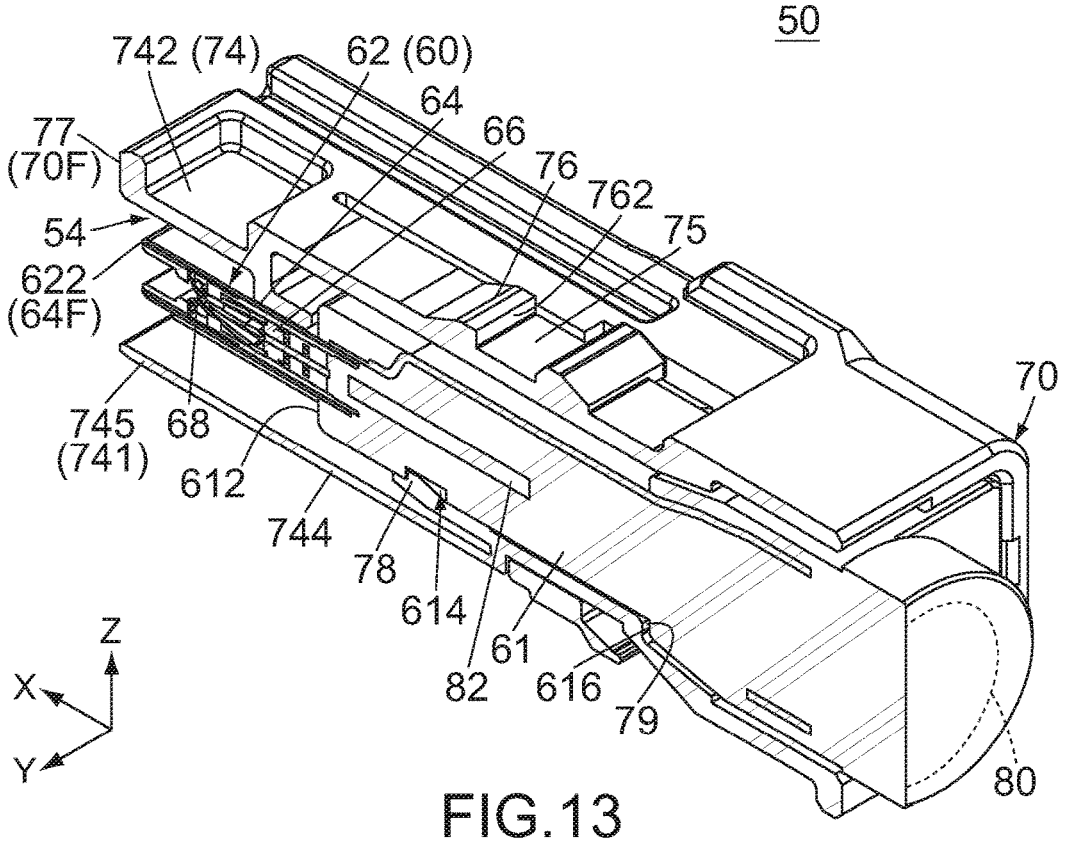
FIG. 13 is a partially cut-away, perspective view showing the second connector of FIG. 9, wherein the cable is not specifically shown except for an outline of its end face which is illustrated with dashed line.
Figure 14:
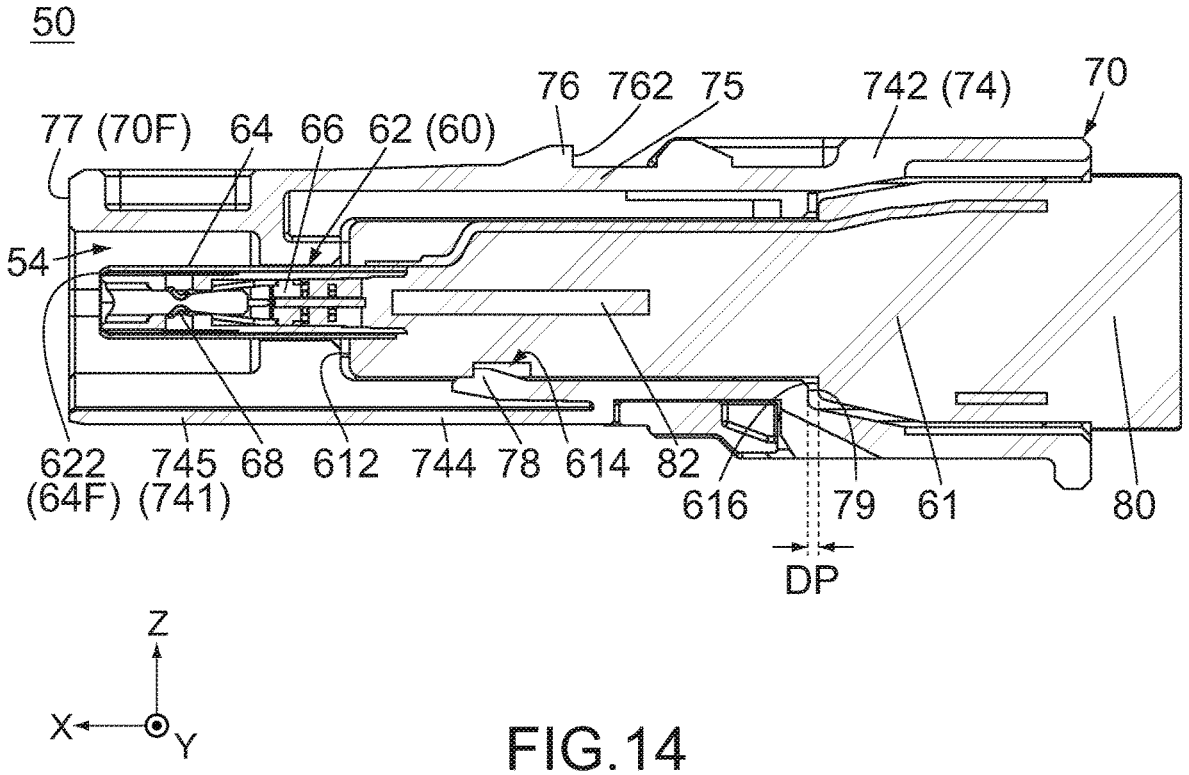
FIG. 14 is a cross-sectional view showing the second connector of FIG. 13.

Referring to FIGS. 9, 13 and 14, the second inner structure 60 of the present embodiment comprises a second connector body 62 and a protection member 61 made of insulator.

Referring to FIGS. 13 and 14, the second connector body 62 is connected to the cable 80 via a relay board 82. The protection member 61 is molded so as to cover a connection portion which includes the relay board 82 and connects the second connector body 62 and the cable 80 with each other. The thus-formed protection member 61 is securely fixed around the cable 80 and protects the cable 80. The second connector body 62 is fixed to a front end of the protection member 61 and projects forward from the protection member 61. The second connector body 62 of the present embodiment is partially embedded in the protection member 61 and is connected to the cable 80, so that the second connector 50 is attached to the cable 80. However, according to the present invention, an attachment method of the second connector 50 to the cable 80 is not specifically limited.

The second inner structure 60 of the present embodiment roughly has the aforementioned structure. However, the present invention is not limited thereto. For example, in a case where the second connector 50 is a receptacle, the second inner structure 60 may comprise only the second connector body 62. Instead, the second inner structure 60 may further comprise another member in addition to the protection member 61 and the second connector body 62.

Figure 12:
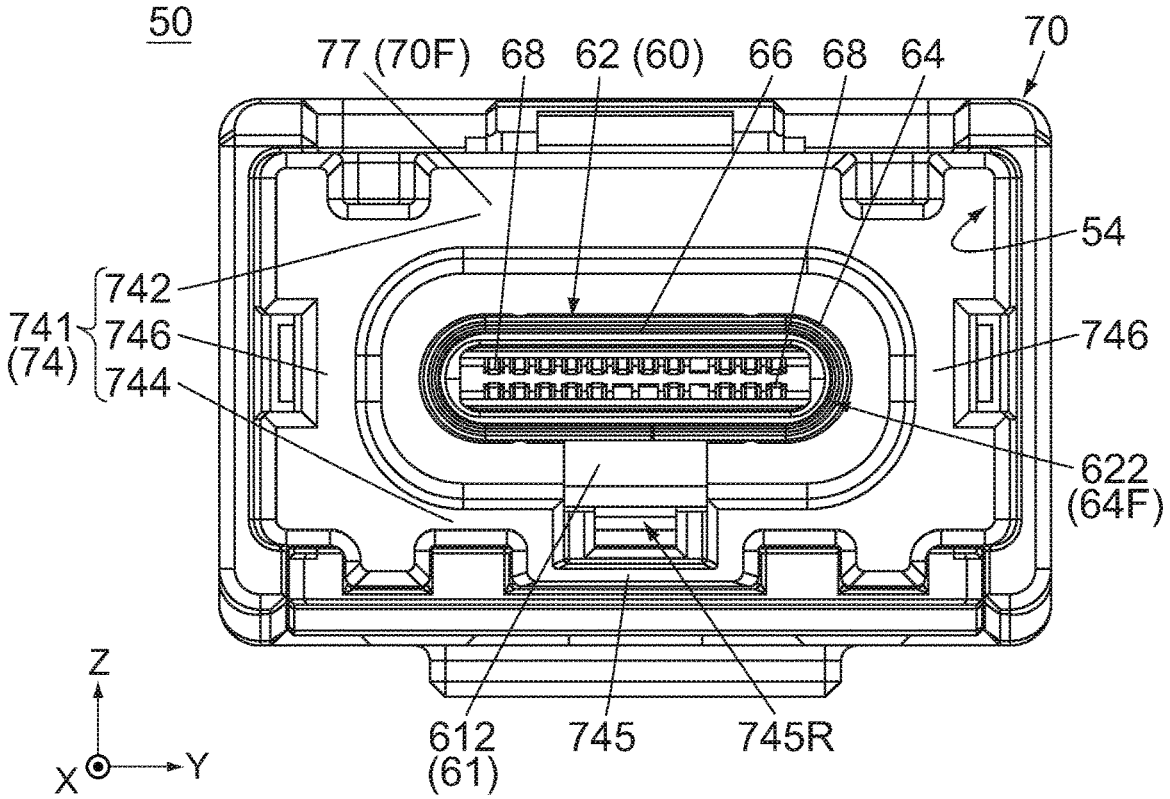
FIG. 12 is a front view showing the second connector of FIG. 9.
Figure 15:
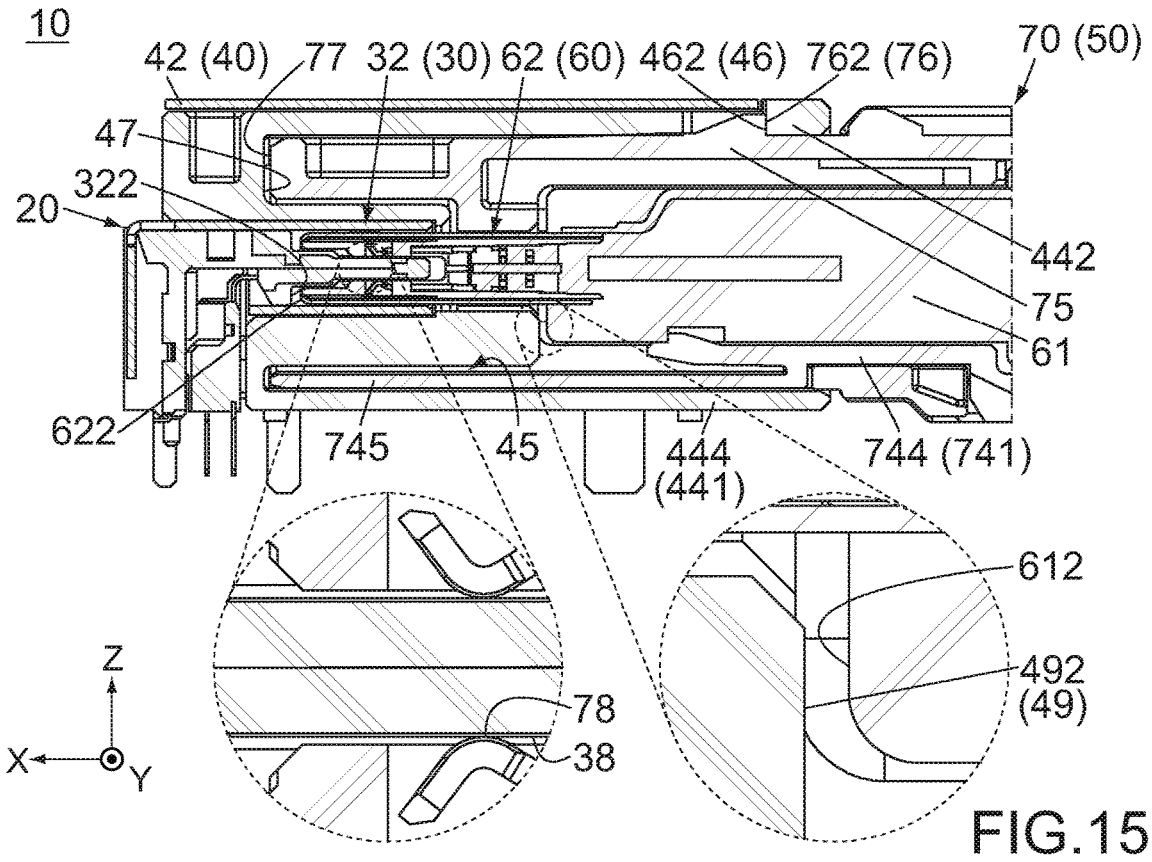
FIG. 15 is a cross-sectional view showing the first connector of FIG. 8 and the second connector of FIG. 14, wherein the second connector is in a state just before it is completely mated with the first connector, a rear part of the second connector is not illustrated, and two parts of the connector assembly each enclosed by dashed line are enlarged and illustrated.

Referring to FIGS. 12 to 14, the second connector body 62 of the present embodiment comprises a second inner shell 64 made of conductor, a second holding member 66 made of insulator and a plurality of second terminals 68 each made of conductor. The second holding member 66 is formed of a plurality of members which are combined to each other. The second terminals 68 are held by the second holding member 66. The second inner shell 64 enclosed the second holding member 66 in the YZ-plane. Each of the second terminals 68 has one end which is connected to a conductive wire (not shown) of the cable 80 via the relay board 82. Each of second terminals 68 has the other end which projects forward from the second holding member 66. Referring to FIG. 15, the other ends of the second terminals 68 are brought into contact with the first terminals 38 of the second connector 50 under the mated state, respectively, so that the cable 80 connected to the second inner structure 60 is electrically connected with the circuit board (not shown) connected to the first inner structure 30.

Referring to FIG. 13, the second connector body 62 of the present embodiment comprises only the second inner shell 64, the second holding member 66 and the second terminals 68 each of which has the structure as described above. However, the present invention is not limited thereto. For example, the second connector body 62 may further comprise another member in addition to the second inner shell 64, the second holding member 66 and the second terminals 68.

Figure 10:
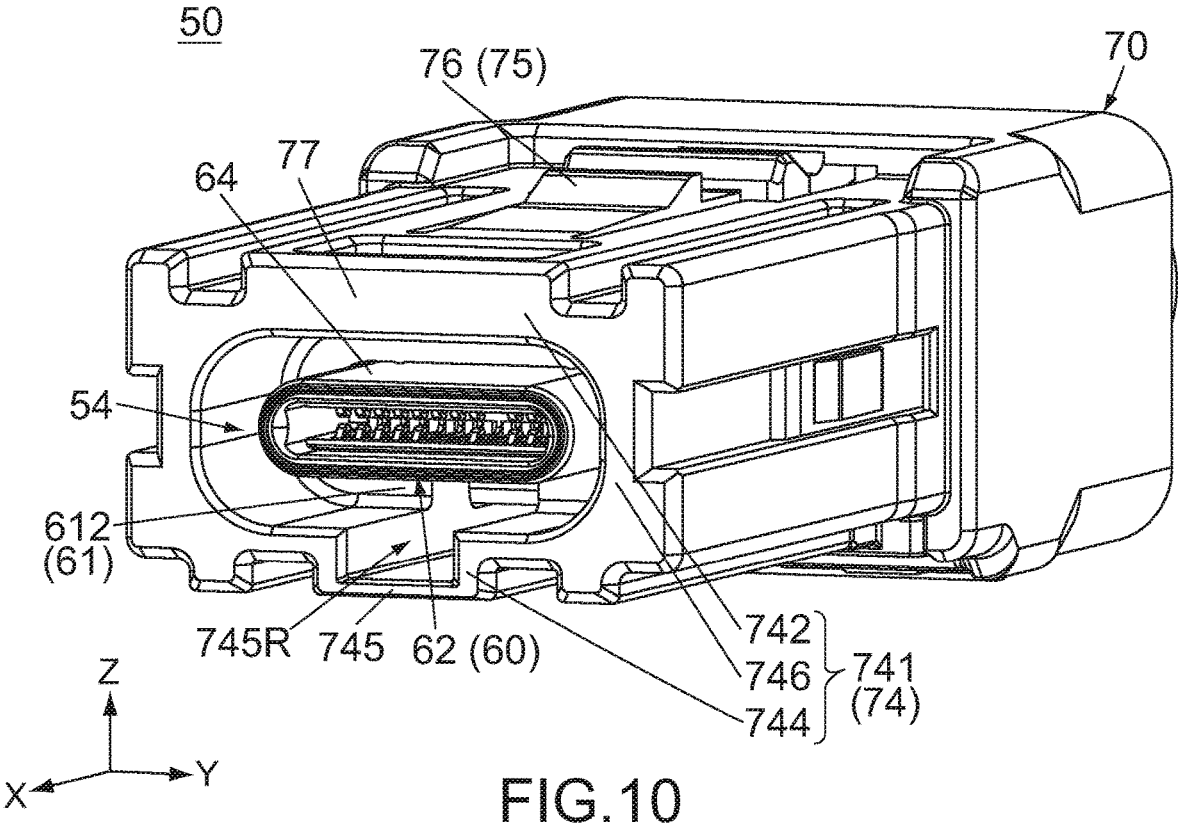
FIG. 10 is another perspective view showing the second connector of FIG. 9.

Referring to FIG. 9, the second outer member 70 of the present embodiment comprises a second outer housing 74 made of insulator. Referring to FIGS. 10 and 12, the second outer housing 74 of the present embodiment has an upper plate 742, a bottom plate 744 and two side plates 746. The upper plate 742 is located on an upper side of the second outer housing 74 and extends along the XY-plane. The bottom plate 744 is located on a lower side of the second outer housing 74 and extends along the XY-plane. The side plates 746 are located on opposite sides of the second outer housing 74 in the Y-direction, respectively, and extend in parallel to each other along the XZ-plane.

The upper plate 742, the bottom plate 744 and the two side plates 746 of the second outer housing 74 form a second outer-peripheral portion 741. Thus, the second outer member 70 of the present embodiment has the second outer-peripheral portion 741. Referring to FIGS. 13 and 14, the second inner structure 60 is inserted into the second outer-peripheral portion 741 from behind together with an end of the cable 80. The thus-inserted second inner structure 60 is held by the second outer-peripheral portion 741. The thus-held second inner structure 60 and the second outer member 70 form a cable harness together with the cable 80. Moreover, the second connector 50 is formed with a second receiving portion 54 which is defined by a front part (positive X-side part) of the second outer-peripheral portion 741. Referring to FIG. 10, the second receiving portion 54 is a space enclosed by the second outer-peripheral portion 741 in the YZ-plane and opens forward. The protection member 61 has a front end 612 which is located at a rear end of the second receiving portion 54.

Figure 11:
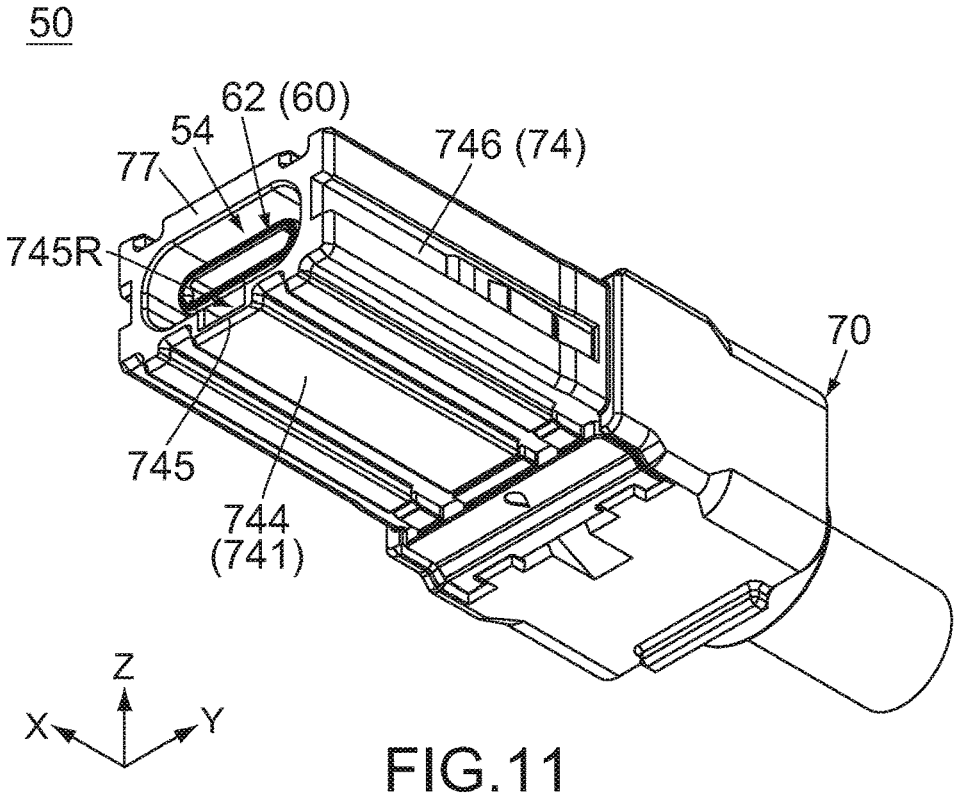
FIG. 11 is still another perspective view showing the second connector of FIG. 9.

Referring to FIGS. 9 to 11, the second outer-peripheral portion 741 of the present embodiment has a recessed portion 745R and an insertion portion 745. The recessed portion 745R is a recess which is recessed downward. The recessed portion 745R is formed in the middle of the bottom plate 744 in the Y-direction. The recessed portion 745R extends along the X-direction and opens forward. The recessed portion 745R communicates with the second receiving portion 54 in the Z-direction. The insertion portion 745 is a part of the bottom plate 744 located under the recessed portion 745R. The insertion portion 745 has a flat-plate shape in parallel to the XY-plane and extends along the X-direction.

Referring to FIGS. 9 and 13, the second outer housing 74 of the present embodiment has a spring portion 75 in addition to the aforementioned portions. The spring portion 75 is formed of a part of the upper plate 742 which is partially cut off from the upper plate 742. The spring portion 75 has opposite ends in the X-direction which are fixed to the upper plate 742. The spring portion 75 has opposite sides in the Y-direction which are separated from the upper plate 742. The spring portion 75 is resiliently deformable because of the aforementioned structure. The spring portion 75 is formed with a lock projection 76. The lock projection 76 is located at the middle of the spring portion 75 in the X-direction. The lock projection 76 is movable in the Z-direction in accordance with resilient deformation of the spring portion 75.

Referring to FIGS. 13 and 14, the second outer housing 74 of the present embodiment has a lance 78 and a stopper 79. The lance 78 and the stopper 79 are located in the second outer-peripheral portion 741. The lance 78 projects upward and forward from the bottom plate 744. The lance 78 is partially received in an engagement recess 614 which is a recess provided in the protection member 61. The lance 78 is engaged with the engagement recess 614 to prevent the second inner structure 60 from coming off the second outer housing 74. When the lance 78 is in contact with a front inner wall of the engagement recess 614, the stopper 79 is located rearward of a stopped portion 616 which is a part of the protection member 61 and apart from the stopped portion 616 by a predetermined distance DP. When the second inner structure 60 is moved forward, the stopped portion 616 is brought into abutment with the stopper 79 so that the forward movement of the second inner structure 60 is stopped.

Referring to FIG. 14, as can be seen from the aforementioned structure, the second inner structure 60 of the present embodiment is held by the second outer member 70 so as to be movable relative to the second outer member 70 along the X-direction by the predetermined distance DP. According to the present embodiment, the lance 78 of the second outer member 70 defines the rear limit position which is the rearmost position of the second inner structure 60 relative to the second outer member 70, and the stopper 79 of the second outer member 70 defines the front limit position which is the frontmost position of the second inner structure 60 relative to the second outer member 70. However, the present invention is not limited thereto. For example, the rear limit position and the front limit position of the second inner structure 60 may be defined by any part or any member.

The second outer member 70 of the present embodiment comprises only the second outer housing 74 which has the structure as described above. However, the present invention is not limited thereto, but the structure of the second outer member 70 can be variously modified. For example, the second outer member 70 may further comprise another member in addition to the second outer housing 74.

Hereafter, explanation will be made about the mated state where the first connector 20 (see FIG. 1) and the second connector 50 are mated with each other.

Referring to FIG. 1, the second connector 50 has a mating portion 52. The mating portion 52 is a front part of the second connector 50 and has a shape insertable into the first receiving portion 22 of the first connector 20.

Referring to FIGS. 15 and 16 together with FIGS. 7 and 13, when the second connector 50 which is under the separated state, or under the state shown in FIG. 1, is moved forward toward the first connector 20, the mating portion 52 of the second connector 50 is received in the first receiving portion 22. Meanwhile, a part of the first inner structure 30 of the first connector 20 which is located within the first receiving portion 22 is received in the second receiving portion 54 of the second connector 50 together with the holding wall 48 and the projecting portion 49 of the first outer member 40. As a result, the first terminals 38 of the first connector body 32 are brought into contact with the second terminals 68 of the second connector body 62, respectively. At that time, the first connector 20 and the second connector 50 are under the mated state where they are mated with each other. Thus, the second connector body 62 is connected to the first connector body 32 under the mated state.

Referring to FIGS. 15 and 16, during a mating operation in which the second connector 50 is mated with the first connector 20, the lock projection 76 of the second connector 50 is moved forward along a lower surface of the upper plate 442 of the first connector 20 while the spring portion 75 is bent. When the second connector body 62 is connected to the first connector body 32, the lock projection 76 is moved to the lock hole 46 of the first connector 20, and the spring portion 75 returns to its initial shape. As a result, the lock projection 76 is received in the lock hole 46. When the thus-located second connector 50 is pulled rearward, a rear surface (negative X-side surface) of the lock projection 76 is pressed against a rear inner wall of the lock hole 46, so that the second connector 50 cannot be removed from the first connector 20. Thus, the lock projection 76 locks the mated state together with the lock hole 46. The lock of the mated state can be released by bending the spring portion 75 to move the lock projection 76 downward of the lock hole 46, so that the second connector 50 can be removed.

As described above, the mated state of the first connector 20 and the second connector 50 is locked by the first outer member 40 of the first connector 20 and the second outer member 70 of the second connector 50. According to a lock mechanism of an existing connector assembly, the second connector body 62 might be brought into abutment with the first connector body 32 before the mated state is locked. In such a case, when the mated state is locked, the second connector body 62 might be pressed against the first connector body 32 to be damaged. In contrast, the connector assembly 10 of the present embodiment has a damage prevention mechanism for preventing damage to the first connector body 32 and the second connector body 62. Hereafter, explanation will be made about the damage prevention mechanism of the connector assembly 10.

Referring to FIG. 8, the first outer member 40 of the first connector 20 has a first lock surface 462, a first regulation portion 47 and a first abutment portion 492. The first lock surface 462 faces forward. The first regulation portion 47 faces rearward. The first abutment portion 492 faces rearward.

The first lock surface 462 of the present embodiment is a surface of the rear inner wall of the lock hole 46. The first regulation portion 47 is a rear surface of the back plate 448. The first abutment portion 492 is a rear surface of the projecting portion 49. Each of the first regulation portion 47 and the first abutment portion 492 is located in the first receiving portion 22. However, the present invention is not limited thereto. For example, each of the first lock surface 462, the first regulation portion 47 and the first abutment portion 492 may be any part of the first outer member 40, provided that it faces in the aforementioned direction. Moreover, the arrangement of the first lock surface 462, the first regulation portion 47 and the first abutment portion 492 is not limited to that of the present embodiment.

Referring to FIG. 14, the second inner structure 60 of the second connector 50 has a second abutment portion (front end) 612. The second outer member 70 of the second connector 50 has a second lock surface 762 and a second regulation portion 77. The second lock surface 762 faces rearward. The second regulation portion 77 faces forward. The second abutment portion 612 faces forward.

The second lock surface 762 of the present embodiment is the rear surface of the lock projection 76. The second regulation portion 77 is a front end 70F of the second outer member 70. The second abutment portion 612 is the front end of the protection member 61 and is located in the second receiving portion 54. However, the present invention is not limited thereto. For example, each of the second lock surface 762 and the second regulation portion 77 may be any part of the second outer member 70, provided that it faces in the aforementioned direction. The second abutment portion 612 may be any part of the second inner structure 60, provided that it faces in the aforementioned direction. Moreover, the arrangement of the second lock surface 762, the second regulation portion 77 and the second abutment portion 612 is not limited to that of the present embodiment.

Referring to FIG. 16, the operator of the mating operation recognizes that the second connector 50 is completely mated with the first connector 20 when the second abutment portion 612 is brought into abutment with the first abutment portion 492 so that the forward movement of the second connector 50 relative to the first connector 20 is stopped. In other words, the second abutment portion 612 is brought into abutment with the first abutment portion 492 when the second connector 50 is mated with the first connector 20, and this abutment prevents a further forward movement of the second connector 50. With this mechanism, the position of each of the first abutment portion 492 and the second abutment portion 612 in the X-direction is designed in consideration of tolerances of various members included in the first connector 20 and the second connector 50, so that the second connector body 62 of the second connector 50 is prevented from being moved to a position at which the second connector body 62 is brought into abutment with the first connector body 32 of the first connector 20.

More specifically, referring to FIGS. 7 and 8, the first connector body 32 of the present embodiment has a facing portion 322. Referring to FIGS. 13 and 14, the second connector body 62 of the present embodiment has an end portion 622. Referring to FIG. 16, under the completely mated state where the first abutment portion 492 and the second abutment portion 612 are brought into abutment with each other, the facing portion 322 and the end portion 622 are apart from each other and face each other in the X-direction. This mechanism prevents damage to the first connector body 32 and the second connector body 62 which might be caused when the facing portion 322 and the end portion 622 are brought into abutment with each other and are pressed against each other. In addition, the first inner structure 30 is prevented from being displaced or removed from the first outer member 40, which might be caused due to a forward force applied to the first inner structure 30.

According to the present embodiment, when the second connector 50 is mated with the first connector 20, the second connector body 62 is received in the first connector body 32. Moreover, the facing portion 322 is a part of the first holding member 36, and the end portion 622 is a front end 64F of the second inner shell 64. However, the present invention is not limited thereto. For example, each of the facing portion 322 and the end portion 622 may be provided on any member. Moreover, when the second connector 50 is mated with the first connector 20, the first connector body 32 may be received in the second connector body 62. In this modification, the first connector body 32 may have an end portion, and the second connector body 62 may have a facing portion.

Under the mated state, the second lock surface 762 faces the first lock surface 462 in the X-direction and regulates a rearward movement of the second connector 50 relative to the first connector 20. The thus-located second lock surface 762 may be in contact with the first lock surface 462. In addition, under the mated state, the second regulation portion 77 faces the first regulation portion 47 in the X-direction and regulates a forward movement of the second connector 50 relative to the first connector 20. The thus-located second regulation portion 77 may be in contact with the first regulation portion 47. As described above, under the mated state, a movement of the second connector 50 in the X-direction relative to the first connector 20 is regulated by the second lock surface 762 and the first lock surface 462 facing each other in the X-direction and is regulated by the second regulation portion 77 and the first regulation portion 47 facing each other in the X-direction. Thus, the mated state is locked by the first outer member 40 of the first connector 20 and the second outer member 70 of the second connector 50.

According to the present embodiment, the position of the second lock surface 762 in the X-direction is designed in consideration of tolerances of various members included in the first connector 20 and the second connector 50 so that the second lock surface 762 can be located apart from the first lock surface 462 under the mated state. In addition, the position of the second regulation portion 77 in the X-direction is designed in consideration of the aforementioned tolerances so that the second regulation portion 77 can be located apart from the first regulation portion 47 under the mated state.

More specifically, the first regulation portion 47 and the first lock surface 462 of the first connector 20 are apart from each other by a first distance D1 in the X-direction. The second regulation portion 77 and the second lock surface 762 of the second connector 50 are apart from each other by a second distance D2 in the X-direction. According to the present embodiment, the first regulation portion 47 is located forward of the first lock surface 462, and the first distance D1 is longer than the second distance D2. As a result, under the mated state, the second outer member 70 is movable relative to the first outer member 40 along the X-direction. Thus, the present embodiment provides the connector assembly 10 having the damage prevention mechanism which allows tolerances and prevents damage to the first connector body 32 and the second connector body 62 during the mating operation of the first connector 20 with the second connector 50.

In the present embodiment, each of the first regulation portion 47, the first lock surface 462, the second regulation portion 77 and the second lock surface 762 is a plane in parallel to the YZ-plane. However, the present invention is not limited thereto. For example, each of the first regulation portion 47, the first lock surface 462, the second regulation portion 77 and the second lock surface 762 may be a sloping surface oblique to the X-direction. Each of the first distance D1 and the second distance D2 described above is a distance in consideration of such a structure. More specifically, each of the first distance D1 and the second distance D2 is a distance on an imaginary line which extends in parallel to the X-direction and which passes through all the first regulation portion 47, the first lock surface 462, the second regulation portion 77 and the second lock surface 762. According to the present embodiment, even on any imaginary line which meets the aforementioned condition, the first distance D1 defined as described above (hereafter, simply referred to as "first distance D1") is longer than the second distance D2 defined as described above (hereafter, simply referred to as "second distance D2").

As previously described, the second inner structure 60 of the present embodiment is movable relative to the second outer member 70 along the X-direction by the predetermined distance DP (see FIG. 14). According to this mechanism of the present embodiment, the second outer member 70 is movable relative to the first outer member 40 along the X-direction by the predetermined distance DP under the completely mated state where the first abutment portion 492 and the second abutment portion 612 are in abutment with each other. Thus, the present embodiment allows a movement of the second outer member 70 relative to the second inner structure 60 and thereby enables a movement of the second outer member 70 relative to the first outer member 40 so that damage to the first connector body 32 and the second connector body 62 is prevented. However, the present invention is not limited thereto. For example, the first inner structure 30 of the first connector 20 may be movable relative to the first outer member 40 similarly to the second connector 50.

As previously described, the first regulation portion 47 of the present embodiment is located forward of the first lock surface 462. However, the present invention is not limited thereto, but the first regulation portion 47 may be located rearward of the first lock surface 462. In this modification, the first distance D1 should be designed to be shorter than the second distance D2. Similarly to the present embodiment, this modification provides the connector assembly 10 having the damage prevention mechanism which prevents damage to the first connector body 32 and the second connector body 62 during the mating operation of the first connector 20 with the second connector 50. Thus, in a structure in which the first regulation portion 47 is located forward of the first lock surface 462, the first distance D1 should be longer than the second distance D2, and in another structure in which the first regulation portion 47 is located rearward of the first lock surface 462, the first distance D1 should be shorter than the second distance D2.

The aforementioned damage prevention mechanism of the connector assembly 10 will be explained here in another viewpoint. The second regulation portion 77 and the second lock surface 762 of the present embodiment are located between the first regulation portion 47 and the first lock surface 462 so as to allow an unstable, slight movement of the second outer member 70 relative to the first outer member 40 under the mated state. However, the present invention is not limited thereto. The second regulation portion 77 and the second lock surface 762 may sandwich the first regulation portion 47 and the first lock surface 462 therebetween so as to allow an unstable, slight movement of the second outer member 70 relative to the first outer member 40 under the mated state.

The connector assembly 10 of the present embodiment can be further variously modified in addition to the already explained modifications. Hereafter, explanation will be made about those modifications.

According to the present embodiment, the first outer member 40 of the first connector 20, which is a receptacle, is provided with the first abutment portion 492 and the lock hole 46. The second inner structure 60 of the second connector 50, which is a plug, is provided with the second abutment portion 612. The second outer member 70 is provided with the lock projection 76. However, the present invention is not limited thereto. For example, if a first connector is modified to be a plug, a first outer member of the first connector may be provided with a first abutment portion and a lock projection. According to this modification, a second inner structure of a second connector, which is a receptacle, may be provided with a second abutment portion, and a second outer member may be provided with a lock hole.

According to the present embodiment, the lock hole 46 is provided so as to be unmovable relative to the first outer member 40, while the lock projection 76 is provided so as to be movable relative to the second outer member 70. However, the present invention is not limited thereto. For example, a lock projection may be provided on the first outer member 40 so as to be unmovable relative to the first outer member 40. In this modification, a part having a lock hole may be provided on the second outer member 70 so as to be movable relative to the second outer member 70.

According to the present embodiment, the first abutment portion 492 is located rearward of the first connector body 32. According to this structure, in the mating operation of the second connector 50 with the first connector 20, the second abutment portion 612 can be reliably brought into abutment with the first abutment portion 492 before the second connector body 62 is close to the first connector body 32. Thus, damage to the first connector body 32 and the second connector body 62 can be more reliably prevented. However, the present invention is not limited thereto. For example, the position of the first abutment portion 492 may be designed as necessary.

Referring to FIG. 7, in the first outer member 40 of the present embodiment, the bottom plate 444 and the projecting portion 49 of the first outer-peripheral portion 441 face each other with the gap 45 located therebetween in the Z-direction. In other words, the first outer-peripheral portion 441 is located outward of the first abutment portion 492 in the YZ-plane while the gap 45 is partially located between the first outer-peripheral portion 441 and the first abutment portion 492. Referring to FIG. 13, the second outer-peripheral portion 741 of the second outer member 70 of the present embodiment covers the second connector body 62 in the YZ-plane. Referring to FIGS. 15 and 16, as the second connector 50 is mated with the first connector 20, the projecting portion 49 of the first outer member 40 is inserted into the recessed portion 745R (see FIG. 10) of the second outer member 70, and the insertion portion 745 of the bottom plate 744 is inserted into the gap 45. As a result, under the mated state, the insertion portion 745 of the second outer-peripheral portion 741 is located inside the first outer-peripheral portion 441 in the YZ-plane and is located in the gap 45.

Referring to FIG. 9, according to the aforementioned structure, the second receiving portion 54 can be entirely covered by the second outer-peripheral portion 741 with no hole, so that intrusion of foreign materials into the second receiving portion 54 can be prevented. However, the present invention is not limited thereto. For example, referring to FIGS. 15 and 16, the first outer-peripheral portion 441 may be located outward of the first abutment portion 492 in the YZ-plane while the gap 45 is, at least in part, located between the first outer-peripheral portion 441 and the first abutment portion 492. Moreover, under the mated state, the second outer-peripheral portion 741 may be, at least in part, located inside the first outer-peripheral portion 441 in the YZ-plane and may be, at least in part, located in the gap 45.

Referring to FIG. 14, according to the present embodiment, the front end 70F of the second outer member 70 is located forward of the front end 64F of the second connector body 62. Thus, the front end 64F of the second connector body 62 is located within the second receiving portion 54. This structure more reliably prevents damage to the second connector body 62. However, the present invention is not limited thereto. For example, the position of the second connector body 62 relative to the second outer member 70 may be designed as necessary.

According to the present embodiment, the second abutment portion 612 is located rearward of the front end 64F of the second connector body 62. This structure enables the second connector body 62 to be deeply inserted into the first receiving portion 22 (see FIG. 8), so that the first connector body 32 and the second connector body 62 can be more stably connected. However, the present invention is not limited thereto. For example, the position of the second abutment portion 612 relative to the second connector body 62 may be designed as necessary.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising a first connector and a second connector, wherein:

the second connector is mateable with the first connector along a front-rear direction under a state where the first connector is located forward of the second connector in the front-rear direction;

the first connector comprises a first inner structure and a first outer member;

the first inner structure comprises a first connector body;

the first outer member is attached to the first inner structure;

the first outer member has a first lock surface, a first regulation portion and a first abutment portion;

the first lock surface faces forward;

the first regulation portion faces rearward;

the first abutment portion faces rearward;

the second connector comprises a second inner structure and a second outer member;

the second inner structure comprises a second connector body and a second abutment portion;

the second connector body is connected to the first connector body under a mated state where the first connector and the second connector are mated with each other;

the second abutment portion faces forward;

the second abutment portion is brought into abutment with the first abutment portion when the second connector is mated with the first connector;

the second outer member is attached to the second inner structure;

the second outer member has a second lock surface and a second regulation portion;

the second lock surface faces rearward;

under the mated state, the second lock surface faces the first lock surface in the front-rear direction and regulates a rearward movement of the second connector relative to the first connector;

the second regulation portion faces forward;

under the mated state, the second regulation portion faces the first regulation portion in the front-rear direction and regulates a forward movement of the second connector relative to the first connector;

the first regulation portion and the first lock surface are apart from each other by a first distance in the front-rear direction;

the second regulation portion and the second lock surface are apart from each other by a second distance in the front-rear direction;

when the first regulation portion is located forward of the first lock surface, the first distance is longer than the second distance;

when the first regulation portion is located rearward of the first lock surface, the first distance is shorter than the second distance; and under the mated state, the second outer member is movable relative to the first outer member along the front-rear direction.

2. The connector assembly as recited in claim 1, wherein the second inner structure is held by the second outer member to be movable relative to the second outer member along the front-rear direction by a predetermined distance.

3. The connector assembly as recited in claim 1, wherein:

the first connector body has a facing portion;

the second connector body has an end portion; and under the mated state, the facing portion and the end portion are apart from each other and face to each other in the front-rear direction.

4. The connector assembly as recited in claim 3, wherein when the second connector is mated with the first connector, the second connector body is received in the first connector body.

5. The connector assembly as recited in claim 1, wherein a front end of the second outer member is located forward of a front end of the second connector body.

6. The connector assembly as recited in claim 1, wherein:

the first outer member has a first outer-peripheral portion;

the first outer-peripheral portion is located outward of the first abutment portion in a perpendicular plane perpendicular to the front-rear direction while a gap is, at least in part, located between the first outer-peripheral portion and the first abutment portion;

the second outer member has a second outer-peripheral portion;

the second outer-peripheral portion covers the second connector body in the perpendicular plane; and under the mated state, the second outer-peripheral portion is, at least in part, located inside the first outer-peripheral portion in the perpendicular plane and is, at least in part, located in the gap.

7. The connector assembly as recited in claim 1, wherein the first abutment portion is located rearward of the first connector body.

8. The connector assembly as recited in claim 1, wherein the second abutment portion is located rearward of a front end of the second connector body.

* * * * *